US009434524B2

(12) United States Patent
Kindig

(10) Patent No.: US 9,434,524 B2
(45) Date of Patent: Sep. 6, 2016

(54) IMPACT BARRIER FOR ENCLOSURE

(75) Inventor: Michael A. Kindig, Chagrin Falls, OH (US)

(73) Assignee: Lincoln Global, Inc., City of Industry, CA (US)

( * ) Notice: Subject to any disclaimer, the term of this patent is extended or adjusted under 35 U.S.C. 154(b) by 1248 days.

(21) Appl. No.: 12/111,638

(22) Filed: Apr. 29, 2008

(65) Prior Publication Data

US 2009/0266739 A1 Oct. 29, 2009

(51) Int. Cl.

| | |
|---|---|
| ***B65D 81/02*** | (2006.01) |
| ***B65D 85/48*** | (2006.01) |
| ***B65D 81/05*** | (2006.01) |
| ***B65D 85/30*** | (2006.01) |

(52) U.S. Cl.

CPC ..... *B65D 81/053* (2013.01); *B65D 85/30* (2013.01); *B65D 2585/6897* (2013.01); *B65D 2585/86* (2013.01)

(58) Field of Classification Search

USPC ..... 52/288.1, 287.1; 206/586, 453; 53/287.1, 288.1; 248/345.1

See application file for complete search history.

(56) References Cited

U.S. PATENT DOCUMENTS

| | | | | | |
|---|---|---|---|---|---|
| 3,049,260 | A | * | 8/1962 | Stone | 217/53 |
| 3,200,547 | A | * | 8/1965 | Johnson | 52/287.1 |
| 3,519,780 | A | | 7/1970 | Potapievsky et al. | |
| 3,762,626 | A | * | 10/1973 | Dorsey | 206/586 |
| 3,836,043 | A | * | 9/1974 | Levin | 206/504 |
| 4,162,729 | A | * | 7/1979 | Kaiser et al. | 206/592 |
| 4,430,833 | A | | 2/1984 | Balzer et al. | |
| 4,558,553 | A | * | 12/1985 | Kolk | 108/27 |
| 4,600,204 | A | * | 7/1986 | Badger | 280/33.992 |
| 4,706,426 | A | | 11/1987 | Rumsey | |
| 4,731,918 | A | * | 3/1988 | Burghardt | 29/525.12 |
| 4,742,916 | A | * | 5/1988 | Galea | 206/586 |
| 4,768,845 | A | | 9/1988 | Yeh | |
| 4,817,902 | A | | 4/1989 | Mason | |
| 4,883,281 | A | * | 11/1989 | Waterman | 280/33.992 |
| 5,000,301 | A | * | 3/1991 | Grenier | 190/127 |
| 5,037,027 | A | * | 8/1991 | Nichols | 229/198.1 |
| 5,131,669 | A | * | 7/1992 | Kinnamon et al. | 280/33.992 |
| 5,278,390 | A | | 1/1994 | Blankenship | |
| 5,306,033 | A | * | 4/1994 | Evans | 280/33.992 |
| 5,312,078 | A | * | 5/1994 | Marsh | 248/220.1 |
| 5,428,929 | A | * | 7/1995 | Reese | 52/288.1 |
| 5,503,471 | A | | 4/1996 | Aspenwall | |
| 5,603,140 | A | * | 2/1997 | Pryce | 16/18 CG |
| D380,680 | S | * | 7/1997 | Sun | D9/456 |
| 5,647,182 | A | | 7/1997 | Rutherford | |

(Continued)

OTHER PUBLICATIONS

ESAB AB, Aristo(TM) Mig U4000i/U5000i, http://www.esab.corwar/ar/sp/productos/upload/AristoMig_U5000_4000i.pdf, Nov. 7, 2006 (printed on Aug. 12, 2008), 2 pages.

(Continued)

*Primary Examiner* — Anthony Stashick
*Assistant Examiner* — Kaushikkumar Desai
(74) *Attorney, Agent, or Firm* — Hahn Loeser & Parks LLP

(57) ABSTRACT

A resiliently deformable shield is affixed to the exterior of an enclosure, housing one or more internal components. The resiliently deformable shield is fashioned with one or more recesses that allow the shield to deform and deflect impact force away from the enclosure walls. Apertures may be fashioned in the shield walls for receiving fasteners that are used affix the shield with respect to the enclosure housing.

15 Claims, 3 Drawing Sheets

(56) References Cited

U.S. PATENT DOCUMENTS

| | | | | |
|---|---|---|---|---|
| 6,051,810 | A | 4/2000 | Stava | |
| 6,125,488 | A | 10/2000 | Vogland et al. | |
| 6,178,576 | B1 * | 1/2001 | Newell | 5/658 |
| 6,206,195 | B1 * | 3/2001 | Cheng | 206/586 |
| 6,260,237 | B1 * | 7/2001 | McCue et al. | 16/404 |
| 6,354,049 | B1 | 3/2002 | Bennett | |
| 6,368,694 | B1 * | 4/2002 | Marsh et al. | 428/99 |
| 6,412,739 | B1 * | 7/2002 | Smith | 248/217.2 |
| 6,419,331 | B2 | 7/2002 | Wei | |
| 6,498,321 | B1 | 12/2002 | Fulmer et al. | |
| 6,629,608 | B2 * | 10/2003 | Hurley et al. | 206/586 |
| 6,682,037 | B1 * | 1/2004 | Ouellette | 248/345.1 |
| 6,725,604 | B1 * | 4/2004 | Vanderpan | 49/380 |
| 6,840,372 | B2 * | 1/2005 | Giles et al. | 206/216 |
| 6,881,469 | B2 * | 4/2005 | Hightower | 428/99 |
| 7,121,562 | B2 * | 10/2006 | O'Quin et al. | 280/33.992 |
| 7,168,208 | B2 | 1/2007 | Ward | |
| D537,337 | S * | 2/2007 | Brockington et al. | D8/499 |
| 7,264,863 | B2 * | 9/2007 | Haymond | 428/99 |
| 7,290,747 | B2 * | 11/2007 | Appelman | 248/345.1 |
| D560,486 | S * | 1/2008 | Ray et al. | D8/403 |
| 7,318,526 | B2 * | 1/2008 | Seelye et al. | 206/586 |
| D575,680 | S * | 8/2008 | Brown | D12/106 |
| 7,507,051 | B2 * | 3/2009 | McCue et al. | 404/9 |
| 7,644,820 | B2 * | 1/2010 | Hohne et al. | 206/523 |
| 2003/0038054 | A1 * | 2/2003 | Hurley et al. | 206/586 |
| 2005/0210788 | A1 * | 9/2005 | Giles et al. | 52/309.1 |
| 2005/0269306 | A1 | 12/2005 | Fulmer et al. | |
| 2007/0023397 | A1 * | 2/2007 | Hohne et al. | 217/36 |
| 2007/0039848 | A1 * | 2/2007 | Burchell | 206/453 |
| 2008/0010780 | A1 * | 1/2008 | McCue et al. | 16/404 |

OTHER PUBLICATIONS

Migatronic, Sigma 300/400/500 Professional Welding-Surprisingly Simple, http://www.migatronic.com/media/leafletsuk/52170032a_sigma.pdf, printed on Aug. 12, 2008, 8 pages.

Search Report for corresponding PCT International Application No. PCT/IB2008/002371, dated Feb. 25, 2009.

* cited by examiner

IMPACT BARRIER FOR ENCLOSURE

TECHNICAL FIELD

The present invention pertains to protective shields for enclosures, and more particularly to protective shields that minimize the damage to an enclosure due to impact.

BACKGROUND OF THE INVENTION

It is well known to construct industrial equipment housed internally within an enclosure. The enclosure usually includes an outer sheet metal cover, configured and painted to match the products branding. The cover is fastened to a base that may also support the internal components of the unit. The enclosure provides protection of the internal components mounted inside, shielding them from certain ambient conditions.

The internal components of the equipment can vary extensively. In some cases, the components are used to control machinery or produce some output based on its makeup, which may be mechanical and/or electrical in nature. One example may include a machine controller. Another more specific example may include a welding power source. In this case, the internal components control output power made available through studs for establishing and maintaining a welding arc.

At times the equipment is subject to impact as when dropped or alternatively when collided with another article or structure. Force from the impact dents or deforms the enclosure. This also damages the internal components housed within the enclosure. As the equipment is moved between sites, damage occurs with some frequency. The corners and edges of the enclosure are particularly susceptible to damage.

What is needed is a protective shield or barrier for the equipment that shields the corners from impact forces that would damage the enclosure and its contents. The embodiments of the subject invention obviate the aforementioned problems. Other uses will become apparent to those skilled in the art.

BRIEF SUMMARY

The embodiments of the present invention pertain to a protective barrier for an associated enclosure that includes a resiliently deformable shield having a generally concave configuration for shielding at least a first portion of the associated enclosure from impact forces, and means for affixing the generally concave cap with respect to the associated enclosure.

In one aspect of the embodiments of the subject invention, the resiliently deformable shield comprises a plurality of wall portions having one or more recesses fashioned within the plurality of wall portions.

In another aspect of the embodiments of the subject invention, the plurality of wall portions define an inner surface, wherein the one or more recesses are fashioned in the inner surface, and further including ribs extending between the one or more recesses.

In yet another aspect of the embodiments of the subject invention, the plurality of wall portions intersect to form a trihedral for protecting a corner of the associated enclosure.

In still another aspect of the embodiments of the subject invention, at least two of the trihedral wall portions are substantially orthogonal.

In even another aspect of the embodiments of the subject invention, the resiliently deformable shield is constructed from a moldable polymer, which may be an elastomeric material.

In another aspect of the embodiments of the subject invention, the resiliently deformable shield is constructed from neoprene.

In another embodiment of the subject invention, an enclosure includes an enclosure housing defined by one or more conjoined wall panels, the enclosure housing operatively encasing one or more associated internal components, a resiliently deformable shield having a plurality of wall portions configuration for shielding at least a first portion of the associated enclosure from impact forces, and means for affixing the resiliently deformable shield to an exterior of the enclosure housing.

In one aspect of the embodiments of the subject invention, said means for affixing comprises one or more fasteners wherein at least one of the plurality of wall portions include an aperture for receiving the one or more fasteners.

In another aspect of the embodiments of the subject invention, said means for affixing comprises an adhesive.

In yet another aspect of the embodiments of the subject invention, the resiliently deformable shield includes at least a first concave portion for forming an air gap between the enclosure housing and the resiliently deformable shield.

In another aspect of the embodiments of the subject invention, the resiliently deformable shield comprises a plurality of wall portions having one or more recesses fashioned within the plurality of wall portions.

In even another aspect of the embodiments of the subject invention, the plurality of wall portions define an inner surface, wherein the one or more recesses are fashioned in the inner surface, and further comprising at least one rib extending between the one or more recesses, wherein at least one rib abuts the exterior surface of the enclosure housing.

In still another aspect of the embodiments of the subject invention, the enclosure housing is constructed from a metal, metal alloy, polymer material, and/or fibrous material, and the resiliently deformable shield is constructed from a polymer.

DETAILED DESCRIPTION OF THE INVENTION

Figure 1:
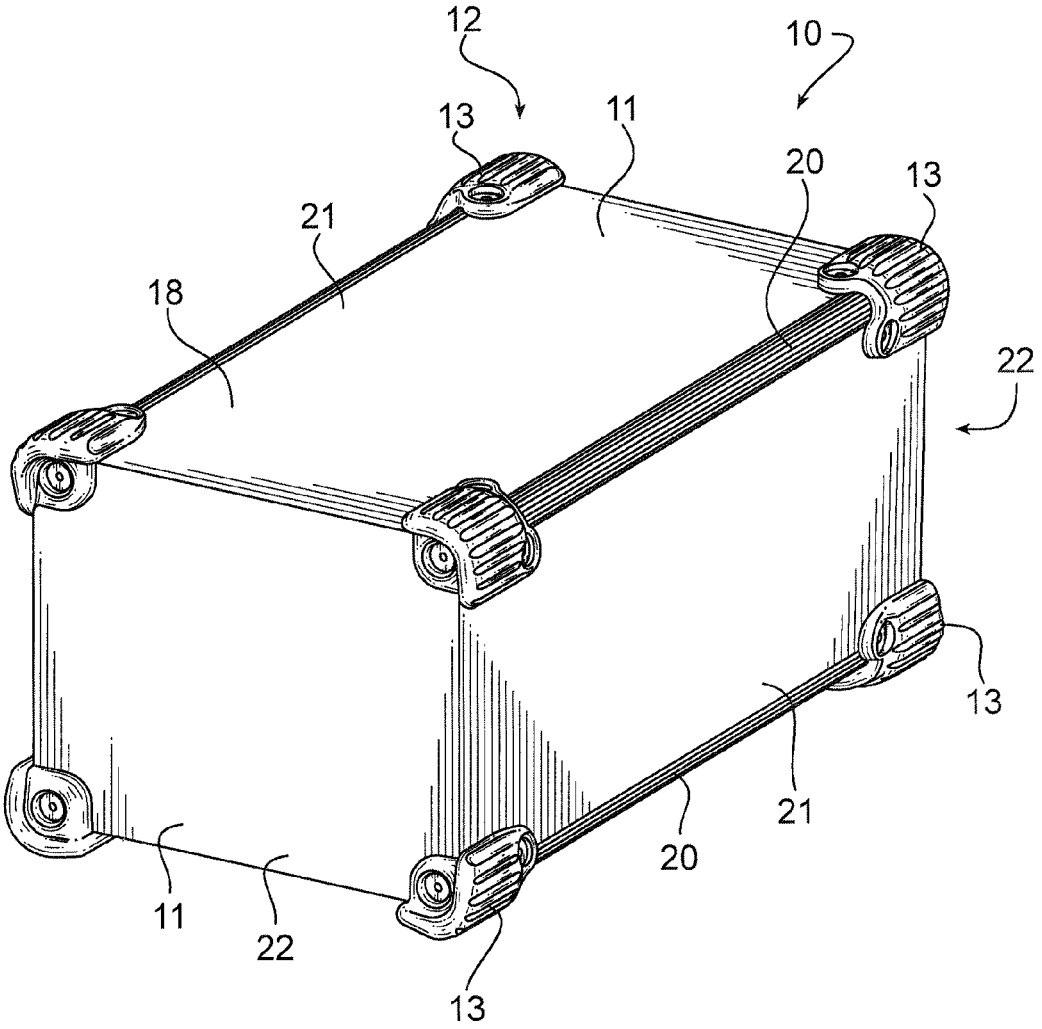
FIG. 1 is a perspective view of an enclosure according to the embodiments of the subject invention.

Referring now to the drawings wherein the showings are for purposes of illustrating embodiments of the invention only and not for purposes of limiting the same, FIG. 1 shows an enclosure depicted generally at 10. The enclosure 10 may be used to house a plurality of components configured to perform a particular operation. The enclosure 10, and associated components, may form a part of machine or may comprise an article of equipment, like for example a machine controller or a welding power source. Although it will be appreciated that the enclosure 10 may house any type and/or quantity of components, mechanical or electrical in nature, without departing from the intended scope of coverage of the embodiments of the subject invention. In one embodiment, the enclosure 10 may consist of a housing or shell 11 for a welding power source 12. As such, the components housed within the shell 11 may include one or more circuit boards, not shown, that function to condition and control power used to establish a welding arc. To prevent the enclosure 10 from damage due to impact, one or more protective barriers 13 may be affixed to the corners of the enclosure 10 to distribute force away from the impact site.

With continued reference to FIG. 1, the enclosure 10 can be constructed from one or more panels or walls 18 fastened together forming a substantially boxlike enclosure 10 having sides 21 and ends 22 defining an enclosed interior region in which the components of the enclosure 10 may be mounted. In this manner, the walls 18 may be oriented at substantially right angles. However, the particular configuration of the enclosure 10 is not to be construed as limiting. Rather the walls 18 may be fashioned to form any shape of enclosure 10 as chosen with sound engineering judgment, which may include rounded edges and corners.

The walls 18 may be constructed from a rigid material. Examples of rigid material may include metal or metal alloys, such as steel sheet metal. Other types of materials may also be used, including but not limited to polymers that have sufficient rigidity to maintain the structure of the enclosure 10 when the various components are mounted within its interior. Slots, holes or other apertures 30 may be formed within the wall as may be necessary for constructing an article of equipment.

With continued reference to FIG. 1, structural members 20 may be used to join the walls 18 together thereby forming joints of the enclosure 10. More specifically, the walls 18 may be affixed to the structural members 20 by fasteners or any other means suitable for constructing a generally rigid enclosure 10. Accordingly, the structural numbers 20 may also be substantially rigid having a length corresponding dimensionally to the length of the walls 18. In one embodiment, the structural members 20 may be constructed from aluminum. Although it will be apparent to those skilled in the art of other types of rigid material may be used. For fastening the walls 18 together, the structural members 20 may include one or more mounting channels configured to receive fasteners. One of ordinary skill in the art will recognize that the fasteners may extend through the walls 18 and into the mounting channel for fixedly attaching the members 18, 20 together. However it should be construed that any means for connecting the walls 18 together can be chosen without departing the intended scope of coverage of the embodiments of the subject invention.

Figure 2:
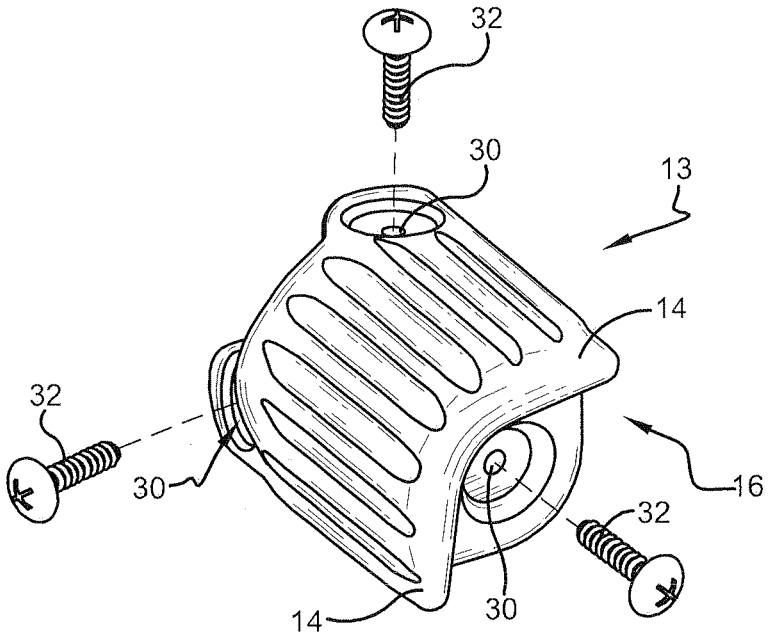
FIG. 2 is a perspective view of a protective barrier for an enclosure according to the embodiments of the subject invention.
Figure 3:
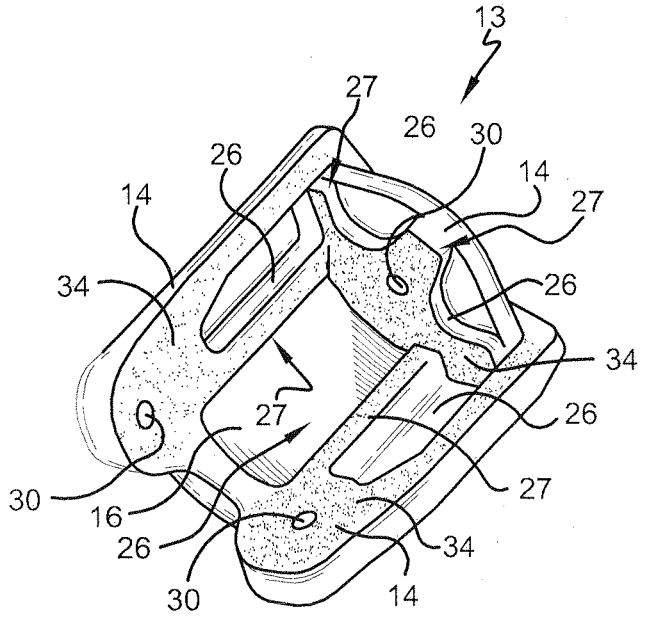
FIG. 3 is a perspective view of a protective barrier for an enclosure according to the embodiments of the subject invention.

With reference now to FIGS. 2 and 3, as mentioned above, a protective barrier 13 may be incorporated for minimizing or reducing the affects of impact on the enclosure 10. The protective barrier 13 may function to diffuse force impacted on a particular region of the enclosure 10. In one embodiment, the protective barrier 13 may be configured for shielding corners and/or edges of the enclosure 10. By shielding it is meant that the protective barrier 13 may absorb forces impacted thereon. Moreover, the protective barrier 13 may distribute impact forces away from the impact site. As such, the protective barrier 13 may be comprised of a resiliently deformable substance, like for example, an elastomeric material. One example of a resiliently deformable material may include neoprene, which is a type of synthetic rubber. Other materials may be utilized for constructing the protective barrier 13 including moldable polymers and thermoplastics. Still, any substance or combination of substances may used for manufacturing the protective barrier 13 as is suitable for minimizing the effects of impact on the enclosure 10.

With continued reference to FIGS. 2 and 3, the protective barrier 13 may be contiguously formed as a unitary article. In one embodiment, the protective barrier 13 may be molded from a polymer substance. Accordingly, a molten or uncured base material may be placed within a mold having a particular configuration. The base material may then be compressed and/or heated to form the final product. The presently described process is illustrative in nature. Any method or process for forming the protective barrier 13 may be chosen with sound engineering judgment.

The protective barrier 13 may include a plurality of wall portions or wall members 14 fashioned to conform to an edge or corner of the enclosure 10. The protective barrier 13 may be constructed from first and second generally planar wall members 14 that intersect to form an angle corresponding to the configuration of the enclosure 10. As described above, the enclosure walls 18 may be oriented at substantially right angles. Accordingly, the wall members 14 of the protective barrier 13 may likewise be oriented at a right angle for conforming to the edge of the enclosure 10. Alternatively, the wall members 14 may be fashioned at a somewhat larger or smaller angle than that of the enclosure walls 18. Still, any angle of orientation may be chosen as is appropriate for use with the embodiments of the subject invention.

In one embodiment, the protective barrier 13 may incorporate three or more wall members 14. In this manner, the protective barrier 13 may take the shape of a trihedral. More specifically, the trihedral protective barrier 13 may be generally orthogonal in nature, although the angles of orientation should not be construed as limiting. In this way, the protective barrier 13 forms a generally concave article, which may be affixed to a corner of the enclosure 10. The wall members 18 define an inner or interior surface 16 and an exterior surface. The interior surface 16 may directly contact the outer surface of the enclosure 10. In one embodiment, the interior may be substantially flat and uniform in configuration. However, other configurations of interior surface 16 may be included as will be discussed further in a subsequent paragraph.

Fasteners may be used to affix the protective barrier 13 to the enclosure 10. Fasteners may include mechanical interlocking devices such screws 32, bolts, rivets, nails and the like. Other means of fastening may also be used including but not limited to: adhesives 34, welding or other bonding techniques chosen with sound engineering judgment. In the current embodiment, threaded fasteners may be used. The protective barrier 13 may include apertures 30 for receiving the threaded fasteners. The threaded fasteners may be inserted through the apertures 30 and secured to the enclosure 10 in a manner well known in the art. More specifically, the threaded fasteners may be screwed into the mounting channels of the structural members 20 described above. Still, the threaded fasteners may be attached to any enclosure component. Each of the protective barrier wall members 14 may be fastened to the enclosure 10 for ensuring a close fit between the enclosure 10 and the protective barrier 13. As such, each individual wall member 14 may include an aperture for securing the protective barrier 13 against movement in any direction.

Figure 4:
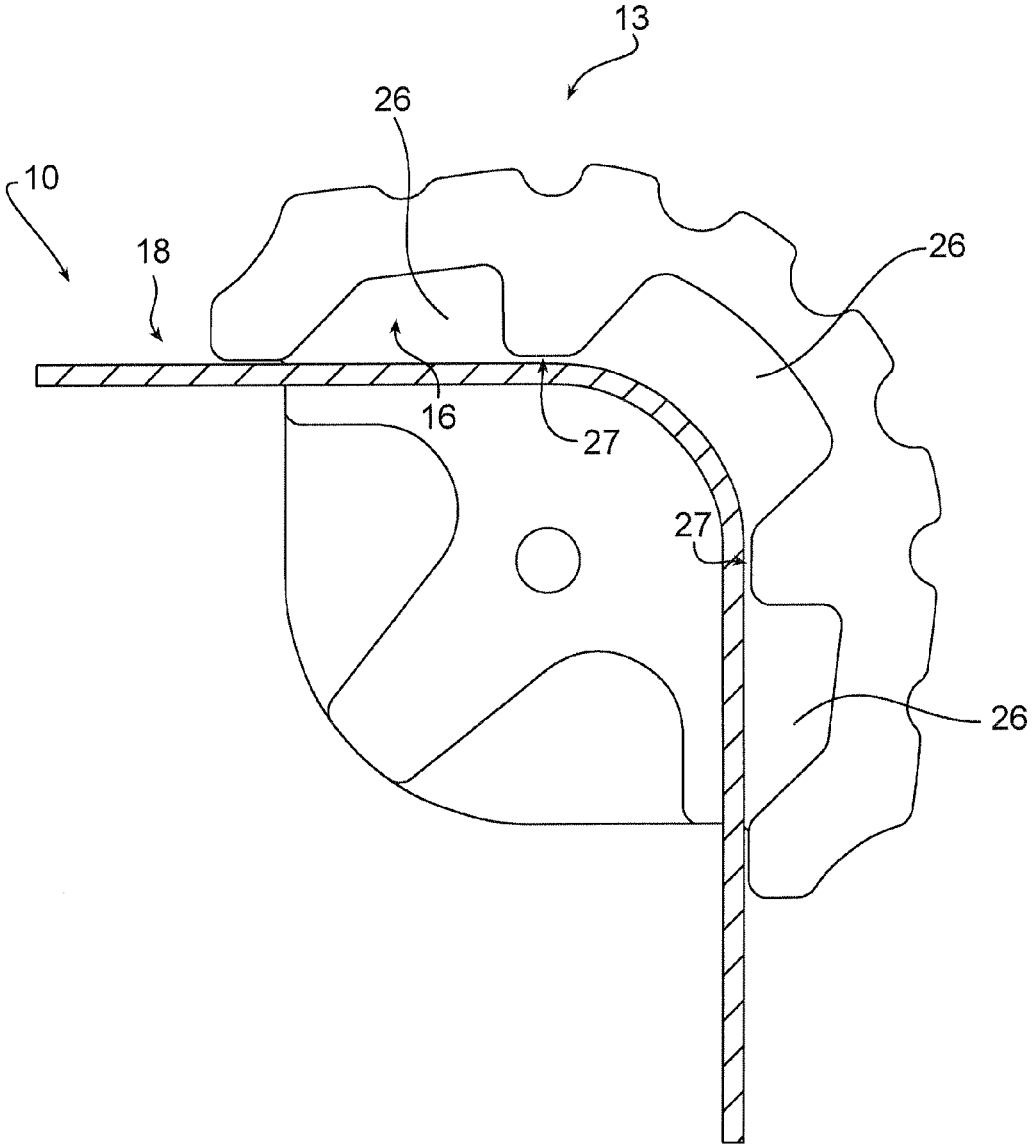
FIG. 4 is a partial cutaway side view of a protective barrier according to the embodiments of the subject invention.

With reference now to FIGS. 3 and 4, the protective barrier 13 may include one or more pockets or recesses 26 fashioned within the wall members 14. The recesses 26 may be devoid of elastomeric material. In one embodiment, the recesses 26 may be formed on the interior concave surface 16 of the protective barrier 13. However, the recesses 26 may be formed on any surface of the wall members 14 or within the wall members 14 without departing from the intended scope of coverage of the embodiments of the subject invention. The recesses 26 may also be separated by ribs 27 that extend to contact the exterior surface of the enclosure 10. In this manner, the protective barrier 13 may deform when impacted with other articles or structures. The force is then absorbed by the protective barrier 13, which deforms and distributes the forces over a broader surface area thus minimizing the damage to the enclosure 10. As the protective barrier 13 is resiliently deformable, it will resume it original shape after impact.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

What is claimed is:

1. A protective barrier, comprising:

a resiliently deformable shield having a generally concave configuration;

said shield having at least two interconnected essentially vertical wall members, and a floor generally orthogonal to said wall members, at least a portion of said at least two wall members extending both above and below said floor;

said wall members of said resiliently deformable shield having one or more recesses fashioned within an interior of said wall members;

said wall members further comprising ribs above a floor of said one or more recesses, extending between the one or more recesses; and, said resiliently deformable shield having at least three apertures disposed therein, each of said apertures dimensioned for insertion of a threaded fastener, one of said apertures positioned within each of said at least two interconnected essentially vertical wall members and at least one aperture disposed within said floor.

2. The protective barrier as defined in claim 1, wherein an interior of the floor has one or more recesses.

3. The protective barrier as defined in claim 2, wherein the one or more recesses in the inner surface of said floor further comprise ribs extending between the one or more recesses.

4. The protective barrier as defined in claim 2, wherein the at least two interconnected essentially vertical wall members and said floor intersect to form a trihedral.

5. The protective barrier as defined in claim 4, wherein at least two of the trihedral wall portions are substantially orthogonal.

6. The protective barrier as defined in claim 1, wherein the resiliently deformable shield is constructed from a moldable polymer.

7. The protective barrier as defined in claim 6, wherein the resiliently deformable shield is constructed from an elastomeric material.

8. The protective barrier as defined in claim 6, wherein the resiliently deformable shield is constructed from neoprene.

9. The protective barrier as defined in claim 1, wherein the resiliently deformable shield is contiguously-formed as a unitary shield.

10. An enclosure, comprising:

an enclosure housing defined by one or more conjoined wall panels;

a resiliently deformable shield having a plurality of wall portions;

at least a portion of said wall portions extending both above and below a generally orthogonal floor;

said wall portions of said resiliently deformable shield having one or more recesses fashioned within an interior of said wall portions;

said interior wall members further comprising raised ribs above a floor of said one or more recesses, extending between the one or more recesses;

an interior of said floor having one or more recesses;

said interior of said floor further comprising ribs extending between the one or more recesses; and, said resiliently deformable shield havinq at least three apertures disposed therein, each of said apertures dimensioned for insertion of a threaded fastener therethrouqh and into said wall panels, at least two of said apertures positioned within said wall portions and at least one aperture disposed within said floor.

11. The enclosure as defined in claim 10, wherein the resiliently deformable shield includes at least a first interior concave portion for forming an air gap between an exterior wall of an enclosure housing and the resiliently deformable shield.

12. The enclosure as defined in claim 11, wherein the plurality of wall portions define an inner surface, wherein the one or more recesses are fashioned in the inner surface; and, further comprising at least one rib extending between the one or more recesses, wherein the at least one rib abuts the exterior wall of the enclosure housing.

13. The enclosure as defined in claim 10, wherein the plurality of wall portions intersect to form a substantially orthogonal trihedral.

14. The enclosure as defined in claim 10, wherein the resiliently deformable shield is contiguously-formed as a unitary shield.

15. The enclosure as defined in claim 10, wherein the enclosure housing is constructed from a metal, metal alloy or polymer material; and, wherein the resiliently deformable shield is constructed from a polymer.

* * * * *